United States Patent [19]

Kasper

[11] Patent Number: 5,042,340

[45] Date of Patent: Aug. 27, 1991

[54] SLICE THICKNESS CONTROL FOR AN AUTOMATIC SLICING MACHINE

[75] Inventor: Frank S. Kasper, Orland Park, Ill.

[73] Assignee: AMCA International Corporation, Hanover, N.H.

[21] Appl. No.: 520,809

[22] Filed: May 9, 1990

Related U.S. Application Data

[62] Division of Ser. No. 716,089, Mar. 26, 1985, Pat. No. 4,941,375.

[51] Int. Cl.[5] ..... B26D 5/26

[52] U.S. Cl. ..... 83/73; 83/74; 83/76.7; 83/77; 83/367; 83/932

[58] Field of Search ..... 83/73, 74, 77, 76.8, 83/76.7, 76.9, 367, 309, 932; 53/544, 543, 542, 435

[56] References Cited

U.S. PATENT DOCUMENTS

| | | | |
|---|---|---|---|
| 3,667,520 | 6/1972 | Flesch | 83/73 |
| 3,906,823 | 9/1975 | Spooner | 83/73 |
| 4,065,911 | 1/1978 | Fagan | 83/73 X |
| 4,136,504 | 1/1979 | Wyslotsky | 53/435 |
| 4,523,501 | 6/1985 | Mengel | 83/73 X |
| 4,580,475 | 4/1986 | Antonissen | 83/73 X |
| 5,548,107 | 10/1985 | Marchese et al. | 83/73 X |

*Primary Examiner*—Frank T. Yost
*Assistant Examiner*—Rinaldi Rada
*Attorney, Agent, or Firm*—Burns, Doane, Swecker & Mathis

[57] ABSTRACT

The thickness of slices cut by an automatic slicing machine is controlled to produce a draft of slices having a predetermined weight. Desired thickness is determined in accordance with the cross-sectional density of the food product being sliced, which is obtained from the weight and thickness of the most recently cut slice or slices. This information is combined with a desired weight for each of the remaining slices to be cut in the draft to control the rate of advance of the food product into a continuously rotating knife so as to obtain the proper thickness.

3 Claims, 4 Drawing Sheets

KNIFE MOTOR
RESOLVER
22
COUNTER
30
$N_n$
+V
$N_d$
32
DIVIDER
34
$W_s$
+V
$W_d$
36
WEIGHER
$W_n$
20
MULTIPLIER
38
MEMORY
$W_{n-1}$
40
$W_l$
42
DIVIDER
$X_b$
44
CONVEYOR MOTOR
28
RESOLVER
46
R
COUNTER
48
$T_l$
FREQ. TO VOLTAGE
24
VCO
26

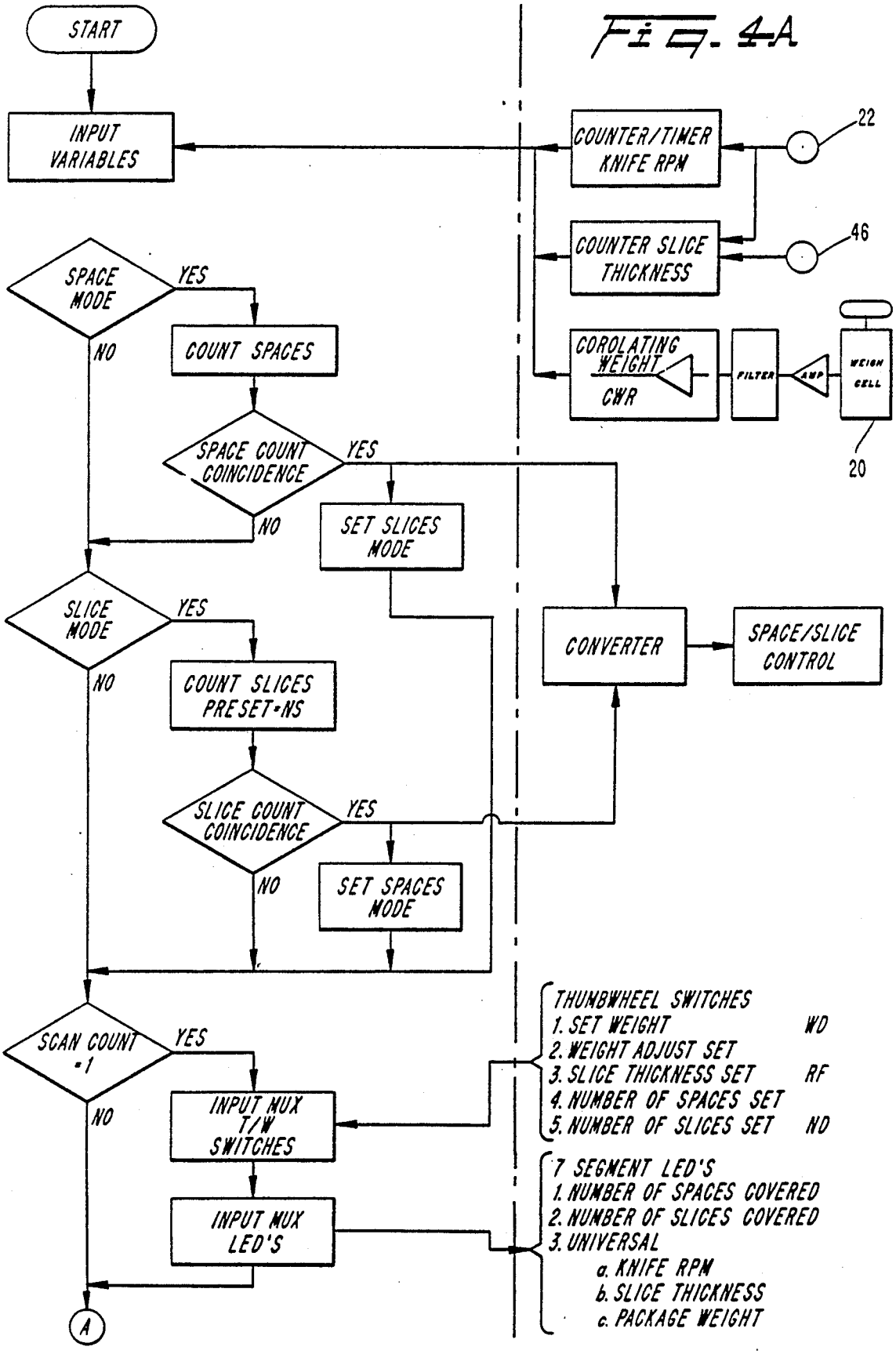
FIG. 4A
START
INPUT VARIABLES
COUNTER/TIMER KNIFE RPM
22
COUNTER SLICE THICKNESS
46
COROLATING WEIGHT CWR
FILTER
AMP
WEIGH CELL
20
SPACE MODE
YES
NO
COUNT SPACES
SPACE COUNT COINCIDENCE
YES
NO
SET SLICES MODE
SLICE MODE
YES
NO
COUNT SLICES PRESET=NS
SLICE COUNT COINCIDENCE
YES
NO
SET SPACES MODE
CONVERTER
SPACE/SLICE CONTROL
SCAN COUNT =1
YES
NO
INPUT MUX T/W SWITCHES
INPUT MUX LED'S
A
THUMBWHEEL SWITCHES
1. SET WEIGHT WD
2. WEIGHT ADJUST SET
3. SLICE THICKNESS SET RF
4. NUMBER OF SPACES SET
5. NUMBER OF SLICES SET ND
7 SEGMENT LED'S
1. NUMBER OF SPACES COVERED
2. NUMBER OF SLICES COVERED
3. UNIVERSAL
a. KNIFE RPM
b. SLICE THICKNESS
c. PACKAGE WEIGHT

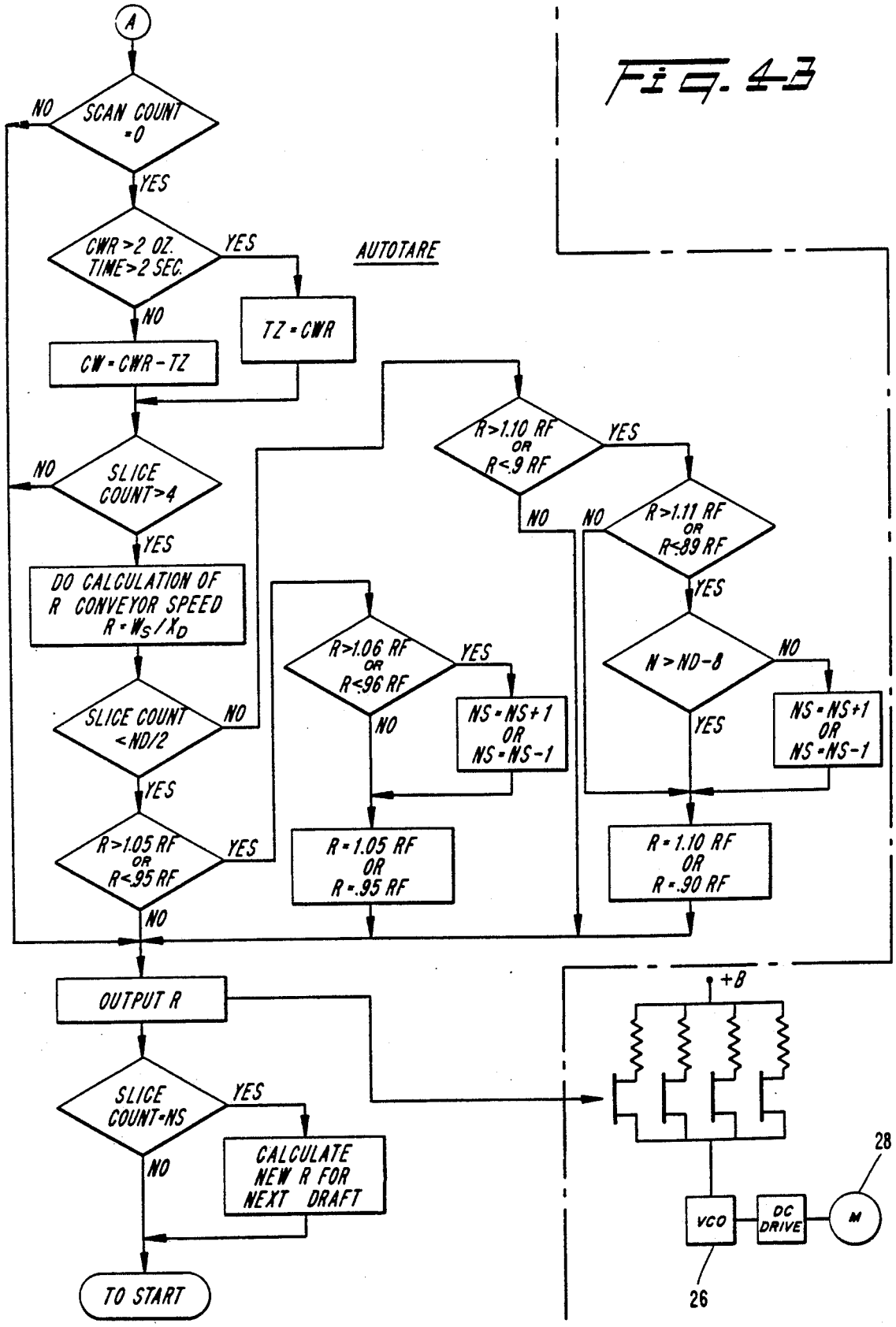
Fig. 4-3
A
SCAN COUNT =0
NO
YES
CWR >2 OZ. TIME>2 SEC.
YES
NO
AUTOTARE
TZ = CWR
CW = CWR - TZ
SLICE COUNT>4
NO
YES
DO CALCULATION OF R CONVEYOR SPEED R = Ws / XD
SLICE COUNT <ND/2
NO
YES
R>1.05 RF OR R<.95 RF
YES
NO
R>1.06 RF OR R<.96 RF
YES
NO
NS = NS+1 OR NS = NS-1
R = 1.05 RF OR R = .95 RF
R>1.10 RF OR R<.9 RF
YES
NO
R>1.11 RF OR R<.89 RF
NO
YES
N > ND-8
NO
YES
NS = NS+1 OR NS = NS-1
R = 1.10 RF OR R = .90 RF
OUTPUT R
SLICE COUNT=NS
YES
NO
CALCULATE NEW R FOR NEXT DRAFT
TO START
+B
VCO
DC DRIVE
M
28
26

SLICE THICKNESS CONTROL FOR AN AUTOMATIC SLICING MACHINE

This application is a divisional of application Ser. No. 06/716,089, filed Mar. 26, 1985, now U.S. Pat. No. 4,941,375.

BACKGROUND OF THE INVENTION

The present invention is concerned with slicing machines, and more particularly is directed to a novel method for automatically controlling the thickness of slices cut by a machine so as to produce a group of slices having a predetermined weight.

In the slicing of food products, for example the slicing of pork bellies into bacon strips, the slicing operation is carried out in a cyclic fashion. During each cycle a predetermined number of slices, forming a group known as a draft, are removed from the product. After one draft is sliced, the slicing operation is momentarily interrupted while this draft is carried away from the slicing blade, for example by a conveyor belt, and then the slicing of the next draft begins so that there is a discernible space between adjacent drafts.

The draft of the sliced product is typically sold according to weight. For example, bacon is often sold in one pound packages. According to various regulations that protect consumer interests, a package of food that is sold according to weight must contain an amount of the food product that weighs at least the amount specified on the package. While it can contain more than the specified weight, from the producer's point of view it is desirable to maintain the amount of food product in the package as close to the specified weight as possible, without going under it, so as to avoid giving away excess amounts of the food product which can result in significant losses when the producer sells a large volume of the product.

Accordingly, various systems have been devised to automatically control the slicing of a food product so that the final draft of the product is as close to the desired weight as is practically possible. One such system is disclosed, for example, in U.S. Pat. Nos. 3,379,233 and 3,379,234. In the system disclosed in these patents, a partial draft of the food product is sliced and then the slicing operation is momentarily interrupted to weigh this partial draft. For example, if a one-pound package of bacon is intended to have 16 slices, the slicing operation will be halted several slices before the last slice is cut. The weight of this partial draft will determine the remaining amount of the product that is necessary to make up the one-pound package. The slicing operation is then resumed, with the number of slices and the thickness of each slice being controlled so as to provide the additional needed weight. The last several slices are cut on the basis of estimations of the thickness necessary to provide the final desired weight. While such a system may be capable of providing a final draft that is close to the desired weight, it will be appreciated that the need to interrupt the slicing operation during each draft results in a significant reduction of production capacity.

Another system which does not require the interruption of the slicing operation during the production of a draft is disclosed in U.S. Pat. No. 3,605,837. In the system of this patent, a curve, or more particularly a step function, is generated to indicate the desired weight of the slices after each slice is cut. For example, if a package of bacon weighing one pound is to be comprised of

16 slices, the desired weight would be incremented by one ounce for each slice. The actual weight of the slices is compared with the desired weight after each slice is cut, and any difference between the two is sent as an error signal to adjust the thickness of the subsequently cut slice.

A variation of this type of system is disclosed in U.S. Pat. Nos. 3,508,591 and 3,995,517. Basically, in the system disclosed in these patents, the weight of the slices that have been cut is extrapolated to calculate the predicted total weight of the package. This predicted total weight is compared with the desired weight for the package, and any difference between the two is used to adjust the thickness of the subsequently cut slices.

While each of these latter two systems would theoretically appear to provide the desired result of producing a draft of slices that is at or near the desired weight, it has been found that they possess undesirable characteristics in actual practice. In the slicing of a food product such as bacon, the shape of the pork belly, i.e., its cross-sectional area, and the ratio of fat to lean in the slice affects its weight, for any given thickness. In addition, physical deformations in the belly, such as large wrinkles and voids, cause slice weight variations. Typically, the shape of the belly and the fat/lean ratio varies as the slicing operation progresses through the pork belly. Accordingly, if each slice in a draft is intended to have a nominal weight, its thickness will have to be varied as the ratio of fat to lean in the pork belly and its shape vary. In systems which operate in the manner of the latter two systems described above, which basically attempt to match the weight of the cut slices to an artificially generated curve, large variations in slice thickness can occur within a single draft if the ratio of fat to lean and/or the shape varies to any appreciable degree within the draft. Further, it is difficult, if not impossible, to achieve the desired final weight with any precision. Such variations in slice thickness are undesirable to the consumer, since, among other things, uniformity of cooking is difficult to obtain.

OBJECTS AND BRIEF STATEMENT OF THE INVENTION

Accordingly, it is an object of the present invention to provide a novel method for dynamically controlling the slicing of a food product in a manner that does not result in significant variations of the thickness of slices within a draft so as to achieve a desired weight and yet avoid the need to interrupt the slicing operation.

It has been found that the problems associated with prior art slicing control systems are largely due to the fact that errors generated by changes in the shape of the belly and in the ratio of fat to lean are not adequately accounted for. Consequently, as the slicing operation progresses, the amount of change in the thickness of the slices that is necessary to effect the desired end weight becomes more and more pronounced.

In contrast, the present invention does not operate on the basis of an error difference between desired and actual weights during a slicing operation. Rather, in accordance with the present invention, the cross-sectional density of the most recently cut slice, or a small number of the most recently cut slices, is determined. This information is used in conjunction with the desired weight for each of the remaining slices in the draft to control the thickness of the remaining slices, so as to result in a final draft that has a desired weight and whose slices are of a more uniform thickness.

Further details of the invention, and advantages provided thereby, are explained hereinafter with reference to a preferred embodiment of the invention illustrated in the accompanying drawings.

BRIEF DESCRIPTION OF THE DRAWINGS

FIGS. 4A and 4B comprise a flow diagram illustrating the operation of a software controlled system that operates similar to the circuit depicted in FIG. 3.

DESCRIPTION OF THE ILLUSTRATED EMBODIMENT

In the following description of preferred embodiments of the present invention, particular reference is made to the slicing of pork bellies to provide a practical illustration of the problem to which the present invention is directed and the advantages which it offers. However, it will be appreciated by those having familiarity with the slicing art that the invention is not limited to this particular application, but rather has a broader range of usefulness in practically any situation in which it is desired to control the thickness of slices as they are being cut to provide a final package having a desired weight.

Figure 1:
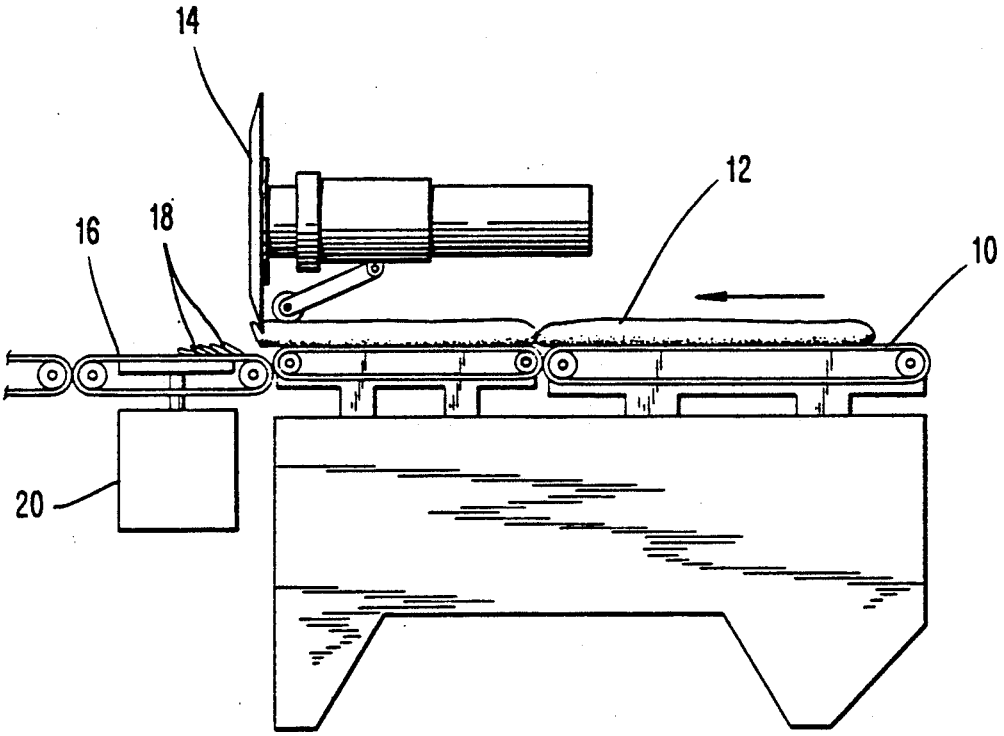
FIG. 1 is a side view in elevation of a slicing machine of the type to which the present invention is applicable.
Figure 2:
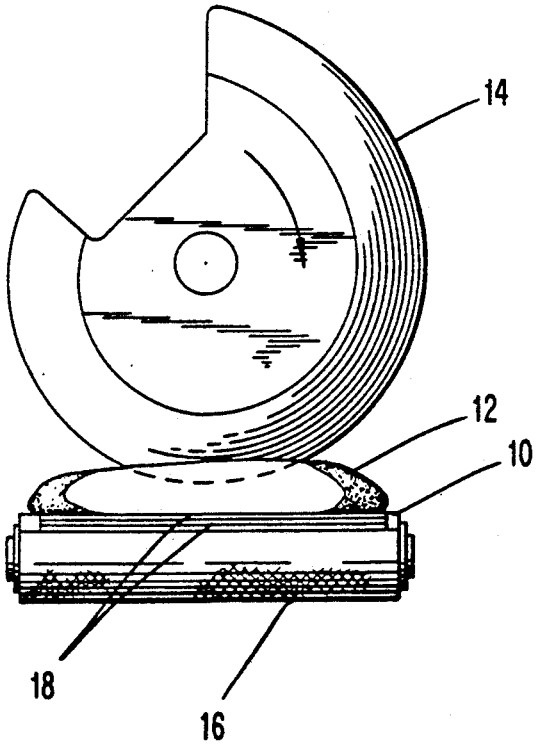
FIG. 2 is a front view of the slicing machine.

Referring to FIGS. 1 and 2, a conventional slicing machine that is typically used for slicing bacon and other similar types of food products is shown in a simplified form. The slicing machine essentially comprises a conveyor belt 10 that feeds the pork bellies 12 to a continuously rotating slicing blade 14. As an alternative to a conveyor belt, other conventional feeding mechanisms, such as a pusher ram or rollers, can be employed. A second conveyor belt 16 is disposed downstream of the feed belt 10 and removes the bacon slices 18 from the location of the slicing blade.

As best illustrated in FIG. 2, the slicing blade 14 has an involute shape, i.e., its radius increases in a circumferential direction. This blade is continuously rotated, and during the slicing of a draft the feed belt 10 continuously feeds a pork belly 12 into the blade. The continuous feeding of the pork belly combined with the involute shape of the blade results in slices of relatively uniform thickness being removed from the pork belly, assuming a continuous rate of feed. These slices are deposited on the conveyor belt 16 in an overlapping or "shingled" arrangement. The revolutions of the slicing blade are counted and after the number of slices necessary to produce a full draft have been removed from the pork belly, the feed conveyor 10 is momentarily interrupted while the product conveyor 16 continues to move. Thus, a space is provided on the conveyor between the end of one draft of slices and the beginning of the next draft that is produced when the operation of the feed conveyor 10 resumes. Preferably, the feed conveyor 10 is retracted slightly at a fast speed between drafts, as disclosed in U.S. Pat. No. 4,226,147, to avoid cutting partial slices while the belt remains stationary.

A weigher 20 is disposed in operative relationship with the product conveyor belt 16 so as to provide an instantaneous indication of the total weight of the slices in the draft as they are being cut. It will be appreciated that as each slice falls onto the conveyor belt 18, it produces a transient in the output signal of the weigher 20 that appears as an a.c. signal. In the context of the present invention, a fast response time is preferable so that a weight reading can be obtained for one slice before the subsequent slice falls onto the belt. Accordingly, it may be desirable to modify the response characteristics of presently available weighing systems so as to increase response time. Such modifications can include the use of a dashpot with high viscosity oil to provide mechanical dampening of the scale. In addition, an electronic valley filter can be used to process the output signal of the weigher so as to reduce the detected amplitude of the oscillations. In practice, since the valley filter detects the minimum peaks in the output signal, it may be necessary to add a constant value to the minimum value of the weigher output signal so as to provide an accurate indication of the actual weight of the slice.

It will be appreciated that in the operation of a machine of the type illustrated in FIGS. 1 and 2, the thickness of each slice is determined by the relative speeds of the conveyor and the knife. More particularly, the thickness T of a slice is defined by:

$$T = S_c / S_k \tag{1}$$

where $S_c$ is the speed of the feed conveyor 10 (measured in inches per second), and $S_k$ is the speed of the knife 14 (measured in revolutions per second). Typically, the speed of the conveyor 10 is tied to the rotational speed of the knife 14 so that changes in the rotational speed of the knife, for example due to load variations or production speed changes, produce corresponding adjustment of the speed of the conveyor so as to maintain slice thickness. Typically, the motor for driving the conveyor 10 is a pulse controlled motor, e.g., a closed loop servo motor. The rotational speed of the knife 14 can be measured and applied as an input signal to a voltage controlled oscillator which provides pulses to the conveyor motor, so as to maintain the speed of the conveyor commensurate with that of the knife.

In the context of the present invention, the speed of the conveyor 10 is also varied in accordance with the measured weight of the slices and the number of slices to be sliced so as to produce a final draft of a predetermined weight. In the process of the invention, slice thickness T is determined in accordance with the cross-sectional density of the most recently cut slice, or the last few slices. Cross-sectional density is a term which describes the weight of a slice as that slice approaches an infinitesimally small thickness. Basically, the weight of a slice is the product of its thickness, its cross-sectional area, and its density, which are determined by the shape and ratio of fat to lean in a slice. The cross-sectional density $X_D$ is the product of the area of the slice and its density, and therefore, is equal to the weight of the slice divided by its thickness. Accordingly, the cross-sectional density of the pork belly in the area where it is being cut can be defined as:

$$X_D = W_L / T_L \tag{2}$$

where $W_L$ is the weight of the last slice cut from the pork belly and $T_L$ is the thickness of the last slice. The weight of the last slice is determined by subtracting the measured weight before the slice is cut from the measured weight after the slice is cut. The thickness is determined by measuring the distance the feed conveyor 10 advances during a single revolution of the knife.

In accordance with the present invention, the latest measured cross-sectional density of the pork belly is used to control the thickness of the remaining slices cut in the draft so as to produce a product of the desired weight, taking into account the number of slices remaining to be sliced and the weight needed to yield the desired weight. In this regard, a desired weight per slice for the remaining slices is first determined. This desired weight per slice $W_s$ is defined as $$W_s = \frac{W_d - W_n}{N_d - N_n} \quad (3)$$

where $W_d$ is the desired final weight of the draft of slices, $W_n$ is the actual weight of the slices that have been cut, $N_d$ is the desired number of slices in the draft, and $N_n$ is the number of slices that have been cut. This calculation provides the weight that each of the remaining slices should have in order to produce a draft of the desired weight.

Once the desired weight of the remaining slices and the cross-sectional density of the pork bellies are known, the slice thickness that is necessary to achieve the final desired weight is determined as follows:

$$T_d = W_s / X_D. \quad (4)$$

Substituting Equation 2, the desired slice thickness thus becomes:

$$T_d = \frac{W_s}{W_L} \times T_L. \quad (5)$$

Finally, substituting Equation 3 for the expression $W_s$, the desired slice thickness is defined as:

$$T_d = \frac{W_d - W_n}{N_d - N_n} \times \frac{T_L}{W_L} \quad (6)$$

Assuming that the speed of the knife is used as the controlling parameter, the speed of the conveyor can be controlled in accordance with Equation 1 and the above determination to produce a draft having the desired weight.

Figure 3:
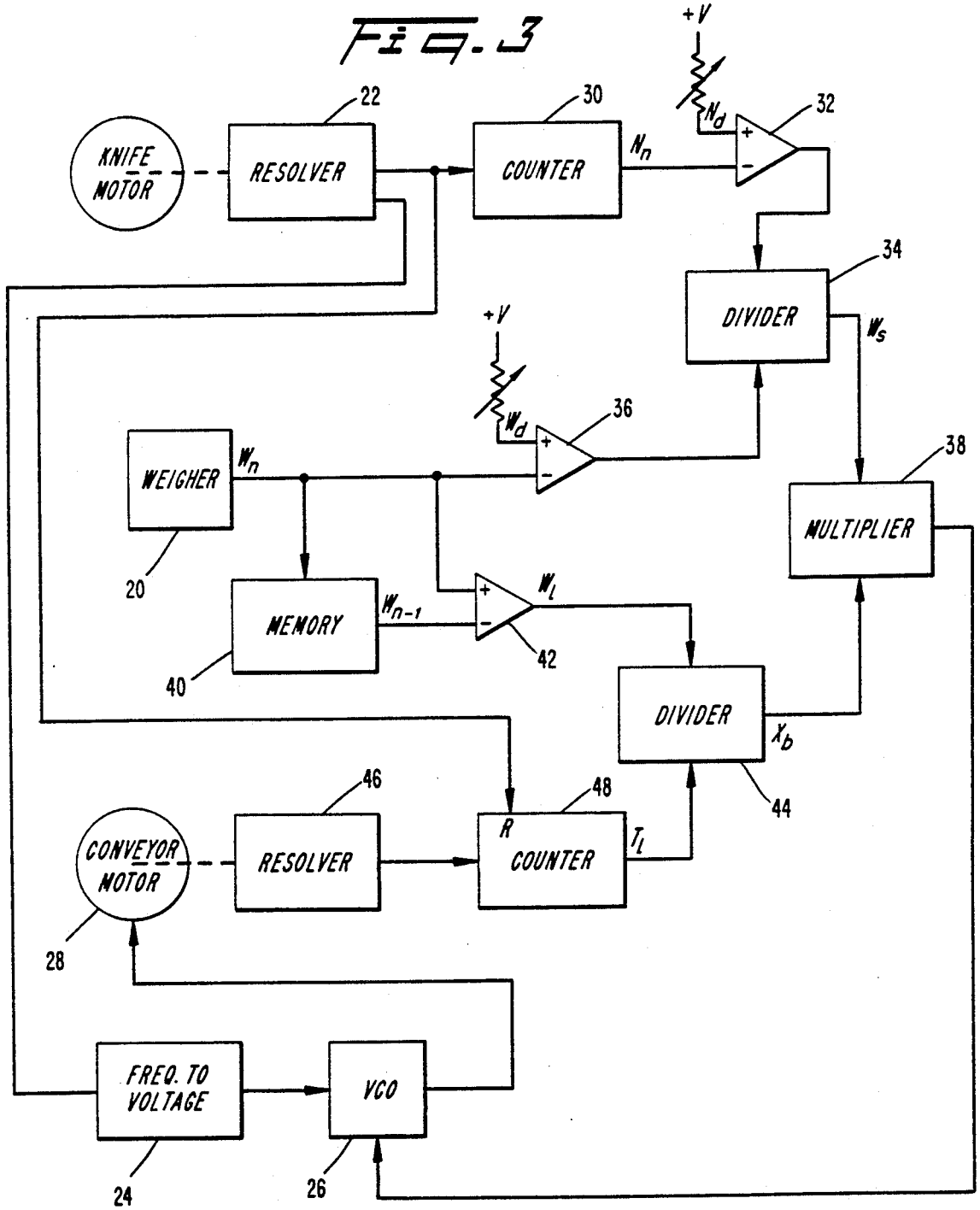
FIG. 3 is a block electrical diagram illustrating the circuit for controlling the slicing operation in accordance with the present invention.

A circuit for controlling the speed of the conveyor in accordance with the foregoing principles is illustrated in block diagram form in FIG. 3. The rotations of the cutting knife 14 are sensed by a resolver or an encoder 22 which can produce a number of pulses per revolution, for example. These pulses are fed to a frequency-to-voltage converter 24, which produces a d.c. output signal having an amplitude which is proportional to the speed of rotation of the knife. This signal is applied to a voltage controlled oscillator 26, which produces output pulses that are supplied to the conveyor motor 28. The frequency of these pulses, as determined by the input signal from the converter 24, controls the speed of rotation of the motor, and hence the rate at which the pork belly is advanced into the knife 14.

A pulse produced during each revolution of the knife motor is fed to a counter 30 which produces an output signal indicative of the number of slices $N_n$ that have been cut thus far in the draft. This signal is applied to one input terminal of a differential amplifier 32, which also receives the desired number of total slices $N_d$ as an input signal. The output signal of the amplifier 32, which is indicative of the number of slices that are remaining to be cut in the draft, is applied to one input terminal of a divider circuit 34.

The output signal from the weigher 20, indicative of the total weight of the accumulated slices on the conveyor 16, is applied to one input terminal of a differential amplifier 36. Another input terminal of this amplifier receives a signal indicative of the desired weight of the draft, and the output signal from the amplifier, which is indicative of the total weight of the slices that are remaining to be cut, is fed as another input signal to the divider 34. The output signal from the divider circuit 34 is representative of the desired weight of each of the remaining slices, and is fed as an input signal to a multiplier circuit 38.

The output signal from the weigher 20 is also fed to a memory 40, e.g. a delay circuit, and to one input terminal of a differential amplifier 42. The memory 40 stores the latest reading from the weigher 20 and produces an output signal indicative of the previous reading from the weigher, which is fed to another input terminal of the differential amplifier 42. The amplifier 42 subtracts the present reading from the previous reading to produce an output signal indicative of the weight of the last measured slice. This signal is supplied to one input terminal of a divider circuit 44.

The movement of the feed conveyor 10 is detected by a resolver 46, which supplies input pulses to a counter 48. The counter is reset by each output pulse from the knife motor resolver 22, so that it counts the number of pulses from the resolver 46 during each cycle of rotation of the knife, to provide an indication of the thickness of the most recently cut slice. Alternatively, pulses from the voltage controlled oscillator 26 can be fed to the counter 48 to provide the same result. The count registered in the counter 48 is fed as another input signal to the divider circuit 44. The output signal from the divider circuit, which is equal to the weight of the last slice divided by its thickness, is representative of the cross-sectional density of the pork belly in the area that is being sliced. This information, when combined in the multiplier 38 with the desired weight per slice from the divider 34, results in a signal being produced that is representative of the desired thickness for the slice. This signal is also used to control the output frequency of the voltage controlled oscillator 26, and hence adjust the speed of the conveyor 10 to obtain slices of the appropriate thickness.

The advantageous results that are achieved by controlling the slicing operation in accordance with the invention are due, at least in part, to the fact that the cross-sectional density of the product in the location where it is being sliced is the controlling factor in determining the thickness of the slices to be cut. Thus, rather than averaging an error over all of the previously cut slices, each slice is examined on an individual basis and the result is used to determine the desired conveyor speed based on the number of slices to be cut and the desired weight of the slices to be cut. This type of control results in a more instantaneous response to variations in the pork belly, rather than being damped by previous results.

For practical considerations, it may be desirable to determine the cross-sectional density on the basis of more than one slice. For example, the weight of the last two or three slices can be divided by their accumulated thickness to determine cross-sectional density. However, it is desirable to limit this determination to the most recently cut slices, rather than the totality of the slices that have been cut, so as to obtain the most relevant information relating to cross-sectional density.

A further advantage results from the fact that any corrections in slice thickness that may be required as a result of examination of the cross-sectional density of the pork belly are carried out over the remaining slices to be cut in the draft. Accordingly, large thickness variations from slice to slice are less likely to occur than in systems which attempt to force the weight of all of the slices that have been cut to match an artificially generated curve.

While a circuit for controlling the conveyor speed in accordance with the present invention is illustrated in hard-wired analog form in FIG. 3, it will be appreciated that the control function can also be implemented digitally through a suitable computer or microprocessor. For example, a flow chart for controlling such a data processor to carry out the process of the invention is illustrated in FIGS. 4A and 4B. The left-hand side of each of the Figures represents the operations that are carried out within the data processor and the right-hand side of each of the Figures depicts the hardware structure that provides input information into the processor or that receives and responds to output signals from the processor.

As a first step in the program, the variables relating to the rotational speed of the knife, the thickness of the last slice (as determined by the speed of the knife and the feed conveyor 10), and the cumulative weight reading CWR are read and stored in appropriate registers. The processor then inquires whether the slicing system is presently slicing the pork belly or is in a spacing mode where the conveyor 10 is interrupted to provide a discernible space between drafts. If the conveyor is halted in the spacing mode, the number of revolutions of the knife are counted until coincidence with a desired number of revolutions (referred to as "spaces" in the flow diagram) is detected. At such time a signal is sent to a converter which synchronizes the output signal with the rotational position of the knife. The synchronized signal is applied to a space/slice control circuit, such as that disclosed in U.S. Pat. No. 4,226,147, to resume operation of the conveyor 10 and begin slicing.

While in the slicing mode, the number of slices that have been cut are counted until the number of slices for a complete draft, NS, have been cut. When this occurs, another signal is sent to the real-time converter to place the machine into the spacing mode, so as to separate the slices of one draft from those of the next draft.

As the next step in the program, additional operator-determined information can be read in. For example, thumbwheel switches can be used to input the desired draft weight WD, the allowable difference between maximum and minimum slice weight, the pre-set slice thickness RF, the number of knife revolutions during the spacing mode, and the desired number of slices ND. During this step of the program, the processor can produce signals to control various LED displays which indicate the number of spaces (knife revolutions) that have been counted, the number of slices counted, knife speed, slice thickness and package weight.

Prior to the slicing of a draft, an auto-taring operation is carried out to calibrate the weight reading. If the cumulative weight reading CWR is greater than 2 ounces and this reading persists for more than 2 seconds, a tare zero value TZ is updated to be equal to the cumulative weight reading. The tare zero value is thereafter subtracted from the cumulative weight reading to give a true, or corrected, weight CW.

During the initial slicing of a draft, no calculations for slice thickness adjustment are made, in order to enable the weigher to settle. After the fourth slice is cut, or such other time as may be necessary to obtain reliable weight readings, the appropriate slice thickness TD is determined, as explained previously with regard to Equations 2–6. In practice, this thickness calculation may be in terms of conveyor speed R, which is inversely related to thickness (Equation 1).

Once the appropriate thickness R is determined, it may be desirable to compare this value to a slice thickness limits that are determined from the pre-set slice thickness RF input by the operator. More particularly, very thin or very thick slices are generally undesirable to the consumer. Accordingly, if the cross-sectional density of the food product indicates that the calculated slice thickness is outside of the desired thickness range, it is preferable to change the total number of slices in the draft so that slices of the appropriate thickness can be utilized.

During early slicing of the draft the maximum slice thickness variation can be 5% of the pre-set thickness, for example. However, in order to provide adequate control, a larger variation may be necessary during the slicing of later slices in the draft. Thus, a decision is first made whether half of the total number of desired slices for the draft, ND, have been cut. If not, the calculated thickness is compared with the preset thickness to determine whether they are within 5% of one another. If so, the processor produces an output signal R to control the conveyor speed on the basis of the calculated thickness. This signal is applied to the voltage-controlled oscillator 26 to provide the appropriate thickness. For example, the signal R may control switches which selectively connect one or more resistors to apply an appropriate input signal of a desired voltage to the oscillator to regulate its output frequency.

If the calculated thickness differs from the pre-set thickness by more than 5%, it is examined to determine whether the two differ by at least 6%. If so, the total calculated slice count for the package, NS, is incremented or decremented by one, as appropriate, and the conveyor speed RF is set at one of the limit values 1.05 RF or 0.95 RF, as the case may be. If the calculated thickness falls between 5 and 6% of the pre-set thickness, the total number of slices is not changed but the conveyor speed is still set at the limit value.

A similar type of operation is carried out for the second half of the slices in the draft, except in this case the limit values are set at 10% of the pre-set slice thickness. In order to prevent a change in the number of slices as the slicing operation nears the end of a draft, the incrementing and decrementing step can be inhibited for the last few, e.g. eight, slices.

The control of the feed conveyor speed in accordance with the desired thickness, as well as incrementing and decrementing of the total number of slices for the package, continues in this manner with each cycle of operation of the data processor until the counted number of slices equals the calculated number NS. At this time the machine is placed in the spacing mode, as explained previously.

In dependence upon the response time of the system and the speed of the slicing operation, a one or two slice delay may be inherent in the control operation. For example, when the knife is rotating at a speed of 1500 r.p.m., the weight, and more particularly the cross-sectional density, of the most recently cut slice that is in the air, i.e. still falling into the weigher, and perhaps also the slice presently being cut may not be accounted for in determining the desired slice thickness. However, the cross-sectional density of the last few slices in the draft are preferably measured after slice count coincidence has been detected and used to calculate a new desired thickness. This calculated thickness is used to control slicing of the first few slices in the next draft, to thereby control slicing on the basis of the latest available information regarding the cross-sectional density of the pork belly.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. An automatic slicing machine, comprising:

a movable slicing blade;

means for moving a product to be sliced into engagement with said blade to produce a draft of slices of the product;

a weigher for weighing a group of slices cut from the product;

means for measuring the speed of at least one of said slicing blade and said product moving means and for determining the thickness of slices cut from the product on the basis of the measured speed;

means responsive to said weigher and said measuring means for determining the cross-sectional density of a number of slices less than the total number of slices in a draft;

means for calculating a desired slice thickness for slices to be cut on the basis of the cross-sectional density determined by said determining means; and means for controlling the speed of movement of at least one of said slicing blade and said product moving means in accordance with said desired slice thickness.

2. The slicing machine of claim 1, wherein said calculating means includes means for determining a desired slice weight for slices in a draft that are to be cut.

3. The slicing machine of claim 1 wherein said cross-sectional density determining means includes means for dividing the weight of a slice by its determined thickness.

* * * * *